United States Patent [19]

Barrick

[11] 4,041,925

[45] Aug. 16, 1977

[54] BOWSTRING RELEASE DEVICE

[75] Inventor: Robert R. Barrick, Parowan, Utah

[73] Assignee: John F. Cowen, Parowan, Utah

[21] Appl. No.: 565,516

[22] Filed: Apr. 7, 1975

[51] Int. Cl.[2] ..... F41B 5/00

[52] U.S. Cl. ..... 124/35 A; 124/24 R; 124/40; 124/41 A

[58] Field of Search ..... 124/35 A, 30 R, 24 R, 124/23 R, 41 A; 273/69; 74/110; 272/40

[56] References Cited

U.S. PATENT DOCUMENTS

| | | | |
|---|---|---|---|
| 1,042,299 | 10/1912 | Weidman | 273/69 |
| 1,655,133 | 1/1928 | Clase | 74/110 |
| 2,319,322 | 3/1943 | Hefel | 74/110 UX |
| 2,417,791 | 3/1947 | Tyszkiewicz | 124/35 A |
| 2,819,707 | 1/1958 | Kayfes et al. | 124/35 A |
| 2,936,749 | 5/1960 | Chellstorp | 125/35 A |
| 2,982,279 | 5/1961 | Pursley | 124/35 A |
| 3,446,200 | 5/1969 | Gross | 124/35 A X |

*Primary Examiner*—Richard C. Pinkham

*Assistant Examiner*—William R. Browne

*Attorney, Agent, or Firm*—Herschel C. Omohundro

[57] ABSTRACT

An archery bow accessory having a hand grip with a bow string holding and releasing mechanism, a draw tube projecting from the hand grip, and a guide connected with the bow and receiving the draw tube. The guide has a lock for retaining the draw tube in a bow flexed position. By drawing back on the hand grip the bow can be flexed and if desired retained in such condition by the lock on the draw tube and guide until an arrow is to be projected. This function can be performed by depressing a plunger with thumb pressure to release the bow string and arrow from the handle. A simple twist of the handle will release the draw tube from the lock on the guide to permit the hand grip to be moved toward the bow for repeating the bow flexing operation. If the bow is to be unflexed without discharging the arrow, the hand grip may be slightly twisted to release the draw tube from the lock in the guide and the bow string moved toward the bow under the control of the operator.

3 Claims, 7 Drawing Figures

BOWSTRING RELEASE DEVICE

BACKGROUND OF THE INVENTION

This invention is directed to the field of sports known as "archery" and, in general, to accessory equipment exemplified by the following U.S. Pat. Nos.:

2,417,791 to Tyszkiewicz; 2,664,078 to Irwin; 2,815,016 to Kellogg; 2,819,707 to Kayfes, et al; 3,446,200 to Gross; 3,561,418 to Fredrickson; 3,672,346 to Plumb.

The present invention resulted from efforts to provide a simpler, more economically constructed device with improved operation.

SUMMARY

This invention relates generally to athletic equipment and more particularly to the sport of archery. Still more particularly, the invention pertains to an accessory employed with an archery bow to facilitate the flexing of the bow, maintaining the bow drawn with a minimum of effort, aiming an arrow, and releasing the drawn bow string to discharge the arrow without jar or other undesirable movement which might destroy the archer's aim.

An object of the invention is to provide an accessory for an archery bow, the accessory having a hand grip with means for taking hold of the bow string to permit the archer to draw the string back and flex the bow, the hand grip also having means for releasing the string to project an arrow.

Another object of the invention is to provide an accessory for an archery bow having a hand grip of the type mentioned in the preceding paragraph, the hand grip having a draw tube projecting forwardly therefrom and received for sliding movement in a guide element removably attached to the archery bow.

A further object of the invention is to provide an accessory for an archery bow of the type mentioned in the two preceding paragraphs, and further providing the guide element with a locking device for holding the draw tube in such guide with the bow string drawn and the bow flexed.

A still further object of the invention is to provide the hand grip mentioned previously with a simple bow string holding device having a minimum number of parts and a compact string releasing mechanism disposed for convenient operation.

Other objects and advantages will be apparent from the following description of one form of the invention which has been illustrated in detail in the accompanying drawings.

IN THE DRAWINGS

DESCRIPTION OF THE DISCLOSURE

Figure 1:
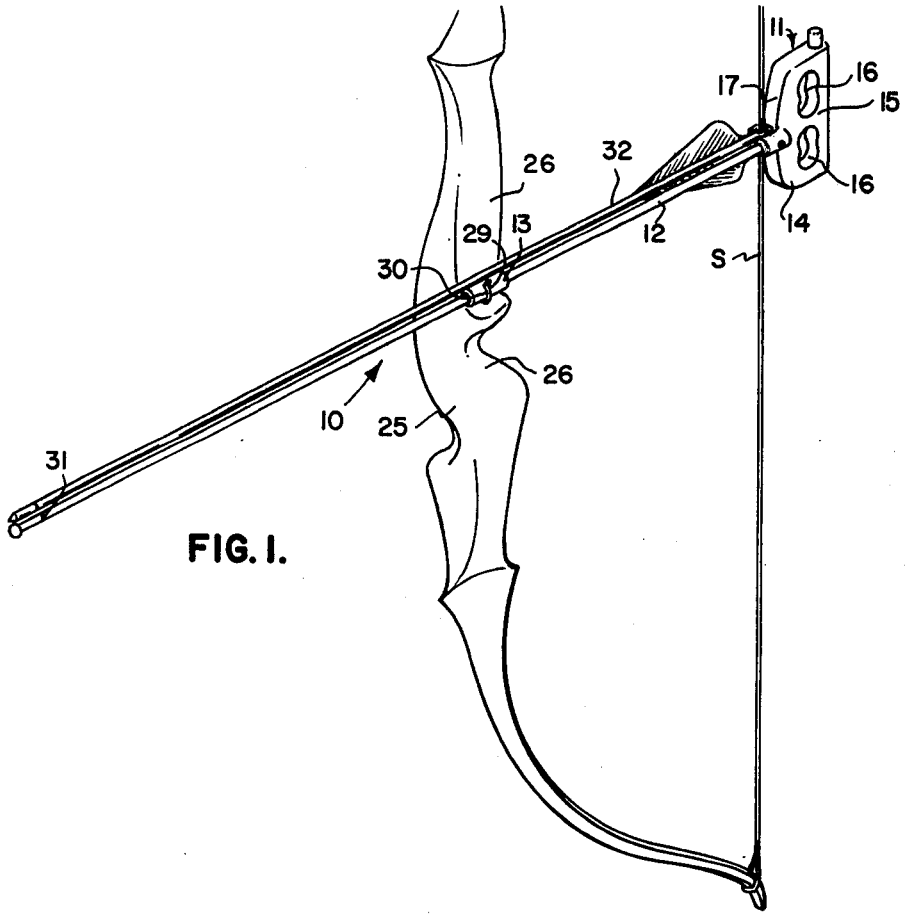
FIG. 1 is a perspective view of an archery bow accessory formed in accordance with the invention applied to a bow.

More particular reference to the drawing will show that an accessory 10 embodying the invention generally includes three main parts, i.e., a hand grip 11, a draw tube 12, and a guide member 13. In some instances the hand grip may be used by itself, but when so used certain advantages of the entire accessory will be sacrificed.

Figure 2:
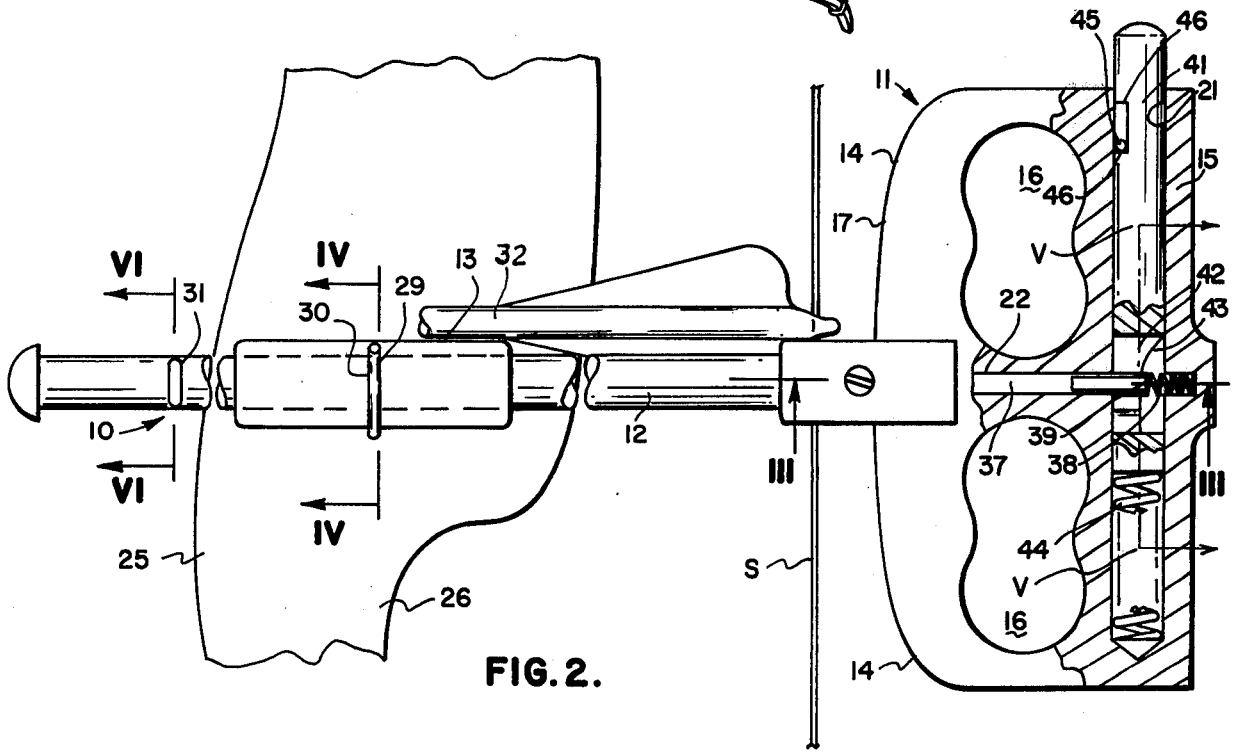
FIG. 2 is a side elevational view on a larger scale of the accessory shown in FIG. 1, certain parts being shown in section.

As shown in FIGS. 1 and 2, the hand grip 11 includes a one-piece element 14, which may be cast or molded of aluminum, plastic or other suitable material, and when viewed from the side, as in FIG. 2, is in the shape of a modified letter B with an upright back bar 15, two finger receiving holes 16, separated by a forwardly projecting portion of the body and a front bar 17 in which is formed a string receiving slot 18, a recess 19 at one side of and opening into the slot, and a bored hole 20 at the opposite side of such slot. The hand grip is also provided with a bored hole 21 entering from the top and extending downwardly through the back bar 15 a predetermined distance. Still another bored hole 22 extends horizontally through the hand grip from the recess 19. The purposes of the bored holes 20,21,22, and recess 19 will be obvious from the following description.

Hole 20 receives the rear end of the draw tube 12 which is secured in place therein by a screw 23 threaded into the hand grip and an opening in the tube 12. As shown in FIG. 2, tube 12, which if desired could be a rod, is slidably received by guide member 13, attached as at 24 to the side of the archery bow 25 adjacent the hand-held portion 26. In the form of invention illustrated, member 13 has a plurality of threaded openings to receive screws 27 extending through holes drilled in the bow. The screws also pass through a clamp plate 28 on the opposite side of the bow from the guide member. It will be apparent that the accessory may be readily removed from the bow when desired merely by withdrawing screws 27.

Figure 4:
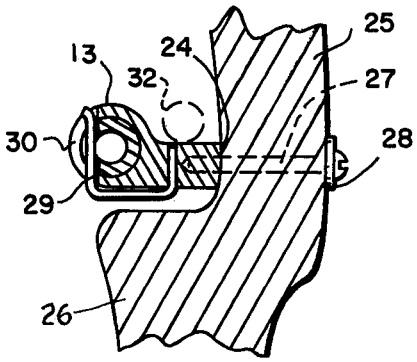
FIG. 4 is a vertical sectional view taken through the accessory at the point of attachment to the archery bow, the plane of this section being indicated by the line IV—IV of FIG. 2.
Figure 5:
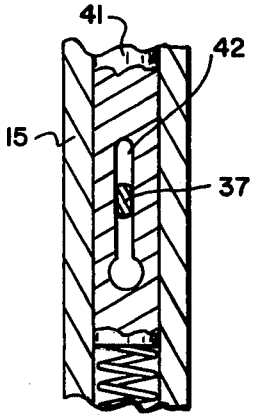
FIG. 5 is a detail sectional view taken on the plane indicated by the line V—V of FIG. 2.
Figure 6:
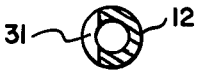
FIG. 6 is a similar view taken on the plane indicated by the line VI—VI of FIG. 2.

From FIGS. 2 and 4 it will be observed that the draw tube can be moved back and forth at will in the guide member 13. In certain instances of use of the archery bow it has been found desirable to lock the draw tube in a predetermined position in the guide member. To perform this function the guide member is equipped with a detent element 29, which in the form selected for illustration consists of a length of spring wire secured at one end in the body of the guide member with a portion adjacent the other end movably received in a slot 30 passing through one side of the guide member. Near its outer end the draw tube is also provided with a slot 31 at one side. When the draw tube is slid rearwardly in the guide member until slot 31 registers with slot 30, detent element 29 will snap into slot 31 to retain draw tube against movement in either direction. It may be released for movement merely by turning the draw tube in the guide until the detent is moved out of slot 31 at which time draw tube may be moved in the guide member. It will be noted from FIG. 4 that when the guide member 13 is secured to the archery bow, the main body portion which guides the draw tube will be spaced slightly from the bow and an arrow 32, shown by a dotted circle, may be rested therein prior to being launched at the target.

As is well known, the arrows are propelled by the bow string after it has been drawn back to flex the bow. To facilitate this operation, the hand grip 11 is provided with the bow string slot 18 and a one-piece catch member 33 to hold the string in the slot during the drawing of the string to flex the bow and until the launching of the arrow.

Figure 3:
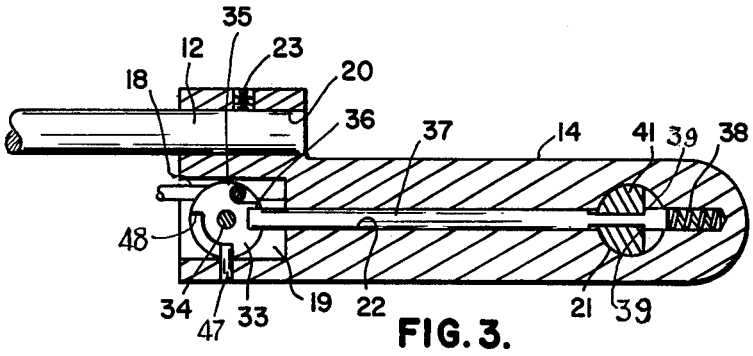
FIG. 3 is a horizontal sectional view taken through the hand grip portion of the accessory on the plane indicated by the line III—III of FIG. 2.

The catch member 33 is mounted in the recess 19 for limited rotary movement about a pin 34. Member 33 has a hook portion 35 which in the active position of the catch, as shown in FIG. 3, extends across the slot 18 and retains the string therein. To prevent the unintentional release of the string, the member 33 has a notch 36 for the reception of a latch pin 37 which is slidable in the bored hole 22 extending through the forwardly projecting portion of the body between finger recesses 16. As shown in FIGS. 2 and 3, pin 37 is resiliently urged toward member 33 by a spring 38 disposed in the hole 22 between the end of the pin and the end of the hole.

Figure 3A:
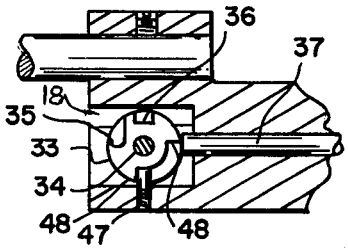
FIG. 3A is a similar view showing portions of the mechanism in different positions than occupied in FIG. 3.

To withdraw the pin 37 from the notch 36 in the string releasing operation, the hand grip has a plunger 41 slidably received in bored hole 21. Plunger 41 has a key hole slot 42 extending therethrough adjacent the lower end and through which pin 37 extends. At the back of the plunger and adjacent one end of the slot 42 there is provided a cam surface 43. This surface cooperates with shoulders 39 formed on the pin 37, when the plunger is depressed, to move the pin against the force of spring 38. When pin 37 is so moved, the end will be withdrawn from notch 36 and the string may move out of the slot 18. As it moves, due to the force of the bow tending to straighten out, the catch member will revolve around its pivot pin to a slot opening position, as shown in FIG. 3A. Insertion of the string into the slot returns the catch member to the point where the latch pin can reenter notch 36 and retain the string in the slot.

Plunger 41 is urged in an upward direction by a spring 44 disposed in the bottom of bored hole 21 below the plunger. Movement of the plunger is limited by a stop pin 45 pressed into the hand grip adjacent a flat surface and between shoulders 46 formed on the plunger near its upper end.

Excess movement of catch member 33 is prevented by a stop screw or pin 47 fixed in the hand grip for engagement by shoulders 48 formed on member 33.

It will be observed that during the assembly of hand grip 11, spring 44 will be inserted in hole 21 followed by the plunger 41 which will be temporarily held in position to cause the registration of the round portion of the key hole slot with bore 22. Spring 38 and lock pin 37 will then be inserted into bore 22 and slipped through the plunger 41 until the shoulders 39 pass the leading edge of cam 43. Plunger 41 may then be depressed until stop pin 45 can be pressed into place between the shoulders 46 on the plunger 41. After the insertion of pin 37, the catch member 33 and its cooperating parts can be inserted in recess 19 and assembled in the hand grip.

As previously suggested, the hand grip 11 may be utilized without the draw tube 12 and guide member 13, but, obviously, their functions would be sacrificed. The hand grip 11 permits the bow string to be drawn to flex the bow without the archer contacting the string with his fingers. It is obvious also that an arrow can be engaged with the string and launched with the hand grip.

With the use of the complete accessory, however, greater accuracy and greater convenience with less effort can be secured.

In the use of the complete accessory, the hand grip is manipulated to position the bow string in slot 18 where it will be held by the catch member 33. The hand grip may then be pulled back away from the bow to flex the same. As the hand grip is drawn back, the draw tube will slip through the guide member 13 until the detent element snaps into slot 31 and locks the draw tube in the guide. This engagement will hold the string drawn and the bow flexed. Either before or after drawing the bow string, the nock of an arrow may be engaged with the string immediately above the part of the hand grip enclosing the catch member, the forward part of the arrow resting on the guide member adjacent the bow.

The accessory will maintain the bow in the flexed condition until the archer launches the arrow. Since the archer does not have to exert any effort to hold the bow flexed, he can concentrate on aiming the arrow. To launch the arrow he merely depresses the plunger 41 with his thumb, the catch member 33 will be released and the string will snap toward the bow, launching the arrow toward the target.

To repeat the operation, the draw tube is released from the detent by turning the hand grip sufficiently to withdraw the detent from slot 31, after which the hand grip may be moved toward the bow again until the bow string will enter slot 18. As previously mentioned, the string will be held by catch member 33 and the hand grip again drawn back to flex the bow.

As mentioned previously, if it is desired or necessary to unflex the bow without launching the arrow after the bow has been drawn, the archer may turn the hand grip to release the draw tube from the detent and move the hand grip toward the bow without releasing the string from the slot 18. It is obvious that the archer will be required to carefully resist the force of the bow to unflex as this operation is performed.

I claim:

1. An accessory for an archery bow, comprising:

a. a one-piece body member shaped to form a hand grip with a bow string receiving slot in the front and a recess at one side of said slot and opening toward the front of said body member;

b. a one-piece catch member mounted in said recess for pivotal movement about a vertical axis, said catch member having a hook on the outer edge to engage a bow string disposed in said slot, said catch member also having a shoulder-forming recess;

c. a latch pin guided in said body member for longitudinal movement toward and away from said catch member, said latch pin having a shoulder formed thereon adjacent the end remote from said catch member;

d. spring means yieldably urging said latch pin toward said catch member to position the end adjacent thereto in said recess to engage the shoulder formed thereby and hold said catch member in bow-string retaining position; and e. a plunger having a cam surface and an opening to receive said latch pin and position the shoulder thereon in registration with and engaging the cam surface on said plunger, the axial depression of said plunger causing the cam surface to react with the latch pin shoulder and move the latch pin out of the recess in the catch member and permit it to pivot and release the bow-string.

2. The acessory for an archery bow of claim 1 in which said opening is key-hole shaped to facilitate the assembly of the latch pin, said spring means, said plunger and associated parts in said body.

3. An accessory for an archery bow, comprising:

a. a one-piece body member shaped to form a hand grip with an upright back bar having a pair of finger receiving recesses and a forwardly projecting portion therebetween, said body member being formed with a bow string receiving slot in the front and a recess at one side of the slot and opening toward the front of said body member;

b. a one-piece catch member mounted in said recess for pivotal movement about a vertical axis, said catch member being generally circular and having a hook on the outer edge to engage a bow string disposed in said slot, said catch member also having a shoulder-forming recess at the edge spaced from said hook;

c. a latch pin guided in a bore extending rearwardly through the portion of said body projecting forwardly from the upright back bar between the finger receiving recesses, said latch pin being movable toward and away from said catch member and having a shoulder formed thereon adjacent the end remote from said catch member;

d. spring means disposed between the inner end of the bore for the latch pin and the end of the latter to yieldably urge the latch pin toward the catch member and position the end of the pin adjacent thereto in said recess to engage the shoulder formed thereby and hold the catch member in bow string retaining position;

e. a plunger disposed in a bore extending axially of the upright back bar of the hand grip, said plunger having a cam surface formed thereon to engage the shoulder formed on said latch pin; and f. resilient means tending to urge said plunger in an upward direction, the depression of said plunger in opposition to the force of said resilient means causing the cam surface on said plunger to react against the shoulder on said latch pin and withdraw the end of the pin from the recess in said catch member and permit said catch member to pivot and release the bow string.

* * * * *